United States Patent [19]

Herlant et al.

[11] Patent Number: 4,865,885

[45] Date of Patent: Sep. 12, 1989

[54] FOOD COLOR STAIN BLOCKING FIBER AGENTS

[75] Inventors: Michel A. Herlant, Mount Pleasant, N.C.; Alexander S. Kirjanov, Reading, Pa.; Vincent W. Bannigan, Jr., Concord, N.C.

[73] Assignee: Crompton & Knowles Corporation, Stamford, Conn.

[21] Appl. No.: 64,856

[22] Filed: Jun. 19, 1987

[51] Int. Cl.[4] ..... B05D 3/00

[52] U.S. Cl. ..... 427/322; 8/527; 8/589; 8/610; 8/666; 252/8.7; 252/DIG. 4; 427/393.4; 427/342

[58] Field of Search ..... 427/393.4, 322, 342; 252/8.7, DIG. 4; 8/527, 589, 610, 666

[56] References Cited

U.S. PATENT DOCUMENTS

| | | | |
|---|---|---|---|
| 4,306,876 | 12/1981 | Hertel | 8/527 |
| 4,317,736 | 3/1982 | Marshall | 252/8.7 |
| 4,501,591 | 2/1985 | Ucci et al. | 427/393.4 |
| 4,619,853 | 10/1986 | Blyth et al. | 428/96 |

*Primary Examiner*—Janyce Bell

*Attorney, Agent, or Firm*—Bernard Francis Crowe

[57] ABSTRACT

This invention relates to a new process and group of products that are useful in preventing nylon and wool fibers, including carpeting and upholstery, from being permanently stained. Fibers can be permanently stained by food colors contained in foods spilled on the fiber. This new group of sulfonated phenol-formaldehyde or naphthol-formaldehyde and anionic surfactant compounds not only block the stain from the fiber but also minimizes any yellowing or discoloration of the treated fibers during the application and during the subsequent exposure to sunlight or commonly used lightfastness testing equipment.

15 Claims, No Drawings

FOOD COLOR STAIN BLOCKING FIBER AGENTS

BACKGROUND OF THE INVENTION

This invention relates to a new group of compositions that are useful in preventing nylon and wool fiber and the fabrics made from them, including carpeting and upholstering fiber, from being permanently stained by food colors contained in foods spilled on the fiber. This new group of sulfonated phenol-formaldehyde or naphthol-formaldehyde and anionic surfactant compositions not only block the stain from adhering to the fiber but also minimize any yellowing or discoloration which ultimately deteriorates the lightfastness typically caused by phenol-formaldehyde or naphthol-formaldehyde condensates.

Heretofore, fibers were treated with acid dye fixing agents, such as INTRATEX ®N, to block the dyeing sites on the fiber. This type of sufonated phenol-formaldehyde condensates prevented the fibers from becoming "dyed" with the food colors, such as FD&C Red 40 in KOOL-AID ®. Additionally, fluorocarbon finishes such as ZEPEL ® and SCOTHCHGARD ® are known to repel water-borne and oil-borne stains, and are usually applied after dyeing, unless they are built into the greige fiber. These finishes, however, do not afford a satisfactory protection against food colors, which is the reason for using Food Color Stain Blocking Agents in addition to the Fluoro-Carbon Finishes.

INTRATEX N, as many other such fixing agents, tends to slightly yellow or discolor the fiber while affecting at the same time its lightfastness. This fact alone limits the amount which can be applied to the fiber, since the amount of yellowing is in direct proportion to the percent of active ingredient exhausted onto the fiber, and this limiting amount is frequently not sufficient to produce the desired stain blocking effect.

In addition, it may be fairly obvious that products such as INTRATEX N are able to convey stain blocking properties to nylon fibers, depending on the type of fiber 6 or 66 and heat-setting history, Seussen (dry heat) Set or Superba (pressurized steam) Set, but it is also obvious that the lightfastness could be seriously impaired.

Additionally, it can be shown that nylon 6 and 66 heatset under dry and humid conditions treated with INTRATEX N type products at different concentrations, temperatures, pH, and times of treatment, reveal that nylon 66 would be the easiest to protect from a standard food color.

It has been shown that the optimum amount of INTRATEX N required to protect nylon 66 from a solution containing FDA Red 40 adjusted at a pH of 2.8–3.0 with citric acid was found to be about 1.0% for Seussen Set and 1.5–2.5% for Superba Set yarn. With nylon 6, much higher concentrations of INTRATEX N are required to achieve the same level of food color stain protection i.e. Seussen Set 2.0–3.0% and Superba Set 3.5–7.0%. Therefore, Nylon 6 Superba Set requires a much higher concentration of INTRATEX N to achieve the same kind of protection possible on nylon 66 and that this higher requirement would severely impair the lightfastness of nylon fiber treated with a stain blocking product.

Likewise, fibers have been treated with anionic surface active agents such as CENEGEN ®7 . These surfactants afford little stain blocking ability to the treated fibers but cause minimal yellowing and have no deleterious effects on the lightfastness of the fibers.

SUMMARY OF THE INVENTION

The present invention provides an improved stain blocking agent for nylon and wool carpets that minimizes the yellowing of the fiber when exposed to sunlight. Specifically, the addition of a sulfonated phenol-formaldehyde or naphthol-formaldehyde condensate to an anionic surfactant produces a synergistic effect capable of blocking food color stains on carpets.

The sulfonated phenol-formaldehyde or naphthol-formaldehyde condensation product is a product containing sulfonic acid groups (ie. $—S_3H$) or a salt thereof (e.g. an alkali metal salt) attached to carbon atoms of the phenolic or naphtholic nucleus. The sulfonated condensation product is preferably prepared by reacting one or more phenols or naphthols with formaldehyde in an appropriate mole ratio, wherein at least one of the phenols or naphthols contains sulfonic acid groups (ie. $—SO_3H$), or a salt thereof (e.g. the ammonium or alkali metal salt), attached directly to carbon atoms of the phenol or naphthol. Alternatively, an unsulfonated phenol or naphthol may be reacted with formaldehyde in an appropriate mole ratio to provide a condensation product that is subsequently sulfonated by treating with fuming sulfuric acid. Examples of the sulfonic group ($—SO^3M^+$) where M is H or a alkali metal such as Na, K or $NH_4$ can be shown by INTRATEX N.

The coloration or stainage obtained with FDA Acid Red 40 can be explained essentially as a dyeing phenomenon, with FDA Acid Red 40 having an affinity for the amino groups ($—NH_2$) in the polyamide fiber. A salt bond between the dye and the amino group is obtained due to the presence of citric or phosphoric acids in soft drinks and in products such as KOOL-AID. The acidity of these drinks is in the area of pH=2.8–3.0 and activates the $—NH_2$ groups to $—NH_3$ (positive) and this increases dramatically the affinity of acid dyes for the fiber (FDA Acid Red 40 contains a $—SO_3$ (negative) grouping).

The concept of blocking the amino groups and rendering them inaccessible to acid dyes is not new. What is new is the ability to combine two products, one a sulfonated phenol-formaldehyde or sulfonated naphthol-formaldehyde condensate and the other an anionic surfactant in order to produce a synergistic effect. Two examples of such products, INTRATEX N and CENEGEN 7, illustrate this ability to produce such a synergistic effect when combined.

Prior work has demonstrated that products of this type when applied individually to the fiber could not impart total stain protection with the desired commercial properties. In fact, INTRATEX N in concentrations of greater then 0.75% of active ingredient causes lightfastness problems. Products such as CENEGEN 7, CONCO AAS and Agent ATSA TE conveyed only mild stain blocking properties, but with the advantage of not affecting lightfastness. The combination of these products not only produced an unexpected total stain blocking result but also an improved lightfastness result over INTRATEX N alone.

PREFERRED EMBODIMENTS OF THE INVENTION

In practice the percent ratio of 60–75 sulfonated phenol-formaldehyde condensate to 25–40 anionic surfactant produces a composition with total stain resistance in carpets and with excellent lightfastness. If the 60–75-/–25 ratio is varied to 80/20, a definite increase in yellow fade occurs under the xenon lamp exposure or direct sunlight.

This invention can be reduced to practice with either powder products or their solutions. In particular, an example of the sulfonated phenol-formaldehyde condensate in solution can be shown as 20% active and the anionic surface active agents solution can be expressed as 45% active. These ratios are based on active material with the compounded product containing 12% active ingredients of the sulfonated phenol-formaldehyde and 18% active ingredient of the anionic surface active agent with water added to sufficiently yield a convenient solution.

In actuality, expressing the above ingredients on their active basis, the ratio range of the phenol-formaldehyde type condensates to the anionic type surface active agents is 4:1 to 0.3:1, with the preferred range between 0.44:1 to 1:1. The pH range will vary from 3.5 to 10.

The procedures for the application of the stain-blocking agents to the carpet can be varied. The following methods can be utilized:

1. Application during exhaust dyeing.
2. As an exhaust aftertreatmnnt following exhaust dyeing.
3. Application during exhaust dyeing and as an exhaust treatment after exhaust dyeing.
4. Application during continuous dyeing.
5. As a continuous aftertreatment.
6. Application during exhaust dyeing and as a continuous aftertreatment.

Sulfonated phenol-formaldehyde condensation products useful in practicing the improvement of the invention are preferably linear, low molecular weight condensation products. These products have an average molecular weight of less than 1000, preferably in the range of 250 to 700, with such products being water-soluble and being able to be prepared by conventional art techniques. An example of these products is a condensation of formaldehyde with one or more phenols in a mole ratio of about 1.0 to 0.8 phenol(s) to formaldehyde at a pH of less than 7 using an acid catalyst such as HCL, wherein at least one of the phenols is a phenolsulfonic acid or alkali metal salt thereof. Preferably the phenols comprise, in addition to the sulfonic acid or salt thereof, a sulfone, for example dihydroxy-diphenylsulfone. Such condensation products contain in addition to sulfonic acid groups or alkali metal salts thereof, sulfone groups i.e.

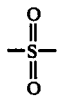

Condensation products of this type are commercially available as INTRATEX N and INTRATEX N-1. A preferred condensation product of formaldehyde with a mixture consisting essentially of an alkali metal salt of para-phenol sulfonic acid and 4,4'- diphenolsulfone in a mole ratio ranging from 1 to 1:4, sulfone to sulfonic acid.

Literally, condensation products useful for practicing the process of the present invention are those prepared from relatively inexpensive, commercially available monomers such as phenol, diphenolsulfone, formaldehyde, ortho-and paraphenolsulfonic acid or salts thereof. Instead of, or in addition to formaldehyde, another aldehyde, such as, furfuraldehyde or benzaldehyde may be used. Also, instead of or in addition to a phenol or phenols, a corresponding naphthol or naphthols may be used, for example instead of sodium phenolsulfonate, sodium naphthol sulfonate may be used. Likewise, the anionic surface active agents can be described as:

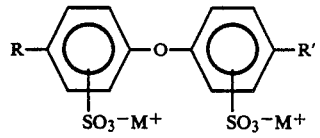

where at least one of the radicals R and R' is an alkyl chain, branched or linear, with 4 to 18 carbons, preferably 10 to 16 carbons. One of the radicals, R and R' may be H. M is H, an alkali metal, $NH_4$ or an amine (primary, secondary, or tertiary). Examples of such are DOWFAX ®2Al by DOW Chemical and CONCOR ® Sulfate 2Al by Continental Chemical. In addition, Alkyl - Aryl Sulfonates such as CONCO ® AAS-40S or Sulframine ® 1298 by Continental Chemical and Wtco Chemical Corp., respectively, can be shown as follows;

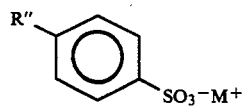

where R'' is an alkyl chain, branched or linear, with 4 to 18 carbons, preferably 10 to 18 carbons. M is H, an alkali metal; $NH_4$ or an amine (primary, secondary or tertiary).

In addition, other common sulfur containing anionics such as alcohol sulfates and alpha - olefin sulfonates can be incorporated into this invention.

EXAMPLE 1

In this example, texturized nylon type 6.6 knit swatches were prepared and were treated with:

A mixture of INTRATEX N: 1.5% 0.W.F. (on weight of fiber) and CENEGEN 7: 1.0% 0.W.F. giving a total of 2.5% 0.W.F. and yielding a ratio of 60% INTRATEX N to 40% CENEGEN 7. This sample was labeled Sample No. 21.

Sample No. 22 consisted of only INTRATEX N: 1.5% O.W.F.

Finally, Sample No. 23 consisted of CENEGEN 7: 1.0% 0.W.F., commercially available from Crompton & Knowles Corporation.

In all cases the application pH was 3 with formic acid. The application was in all cases: 20 minutes at 170° F. at a liquor to goods ratio of 40 to 1. The swatches were rinsed and dried.

A portion of each was saturated in a KOOL-AID ® cherry solution for four hours. The samples were rinsed in tap water.

The results obtained were as follows:

0 Sample No. 21=no stain
Sample No. 22=slight stain (insufficient)
Sample No. 23=heavily stained This example illustrates, as stated previously, that sulfonated phenol-formaldehyde alone (ie. IN- TRATEX N) affords insufficient stain blocking results at the concentration chosen, that the anionic surfactant (ie. CENEGEN 7) affords very slight stain blocking results, and the combination produces a synergistic effect of total stain blocking.

EXAMPLES OF APPLICATION PROCEDURES ON NYLON 6.6

1. As an Aftertreatment when Beck Dyeing—Start cold with 2.5 to 3.5% O.W.F. of the mixture of INTRATEX N 60%, CENEGEN 7 40%. Run 10 minutes—Add Sulfamic Acid for pH 2.5–3.5.

Heat to 140° F. and run 20 minutes.

Drop. Rinse, if desired.

2. As a Continuous Aftertreatment

When carpet exits steamer—(rinse) vacuum and apply with applicator or spray unit, to about 300% wet pick-up, a hot solution (170° F.) containing 10–15 g/1 of the mixture of INTRATEX N 60%, CENEGEN 7 40%. Allow an exposure of about 30 seconds before rinsing and drying. 20–30 g/1 (pH 2.5) of the mixture of INTRATEX N 60%, CENEGEN 7 40% can also be sprayed (100% pick-up minimum) on with the carpet about ⅔ inside the steamer. A minimum steaming time of 30–60 seconds is required.

Note: To achieve good penetration, it is essential to have at least 200% wet pick-up.

3. During Beck Dyeing

Acceptable results have been obtained when adding the mixture of INTRATEX N 60%, CENEGEN 7 40% to the dyebath at the beginning, at a pH adjustment, for best results, not higher than 6.5. As much as 3.0 to 3.5% O.W.F. of mixture is needed on Seussen-Set yarn and 4.0 to 4.5 O.W.F. on Superba-Set Nylon 6.6.

4. During Continuous Dyeing

A mixture of INTRATEX N 60%, CENEGEN 7 40% is added to the dyebath at a concentration equivalent to 3–5% O.W.F. The concentration will vary according to the heat history of the fiber, as well as the pH value. The pH should be acid—as low as possible to allow proper exhaustion of the mixture of INTRATEX N 60% and CENEGEN 7 40% during the short steaming time. The levelness of the dyeings must be kept in mind when selecting a pH in the acid range.

Suggested pH values: 4.0–4.5.

EXAMPLE 2

Nylon 66 carpet Seussen Set yarn was knitted into a sleeve (knit tubing) for easier handling and evaluation of the products' effectiveness. A 25 gram nylon sleeve was padded (impregnated and squeezed out between rubber rolls) with a wet pick up of 140% with 10 g/1 of the product tested, pH 2.5. The padded piece was steamed for about 2 minutes and subsequently rinsed in water. (Steaming was done in saturated steam at 110° C./212° F. with 100% relative humidity). After rinsing, the knit tubing was extracted and dried. To evaluate the effectiveness of the treatment, the nylon knit tubing was subjected to a standard KOOL-AID test (fiber saturated with KOOL-AID for five minutes, removed, exposed to air for four hours and washed with water). In addition, the nylon knit tubing was exposed to 40 standard fading units in a Xenon lightfastness tester. The following results were obtained:

| | | Food Color Stain BLOCKING ACTION | Effect of Exposure in Xenon Light |
|---|---|---|---|
| TREATMENT 1 | | | |
| CENEGEN 7 | 10 g/1 | 3–4 | None |
| TREATMENT 2 | | | |
| INTRATEX N-1 | 10 g/1 | 5 | Very noticeable |
| TREATMENT 3 | | | |
| CENEGEN 7 | 4 g/1 | 5 | Sli. noticeable |
| INTRATEX N-1 | 6 g/1 | | |
| CONTROL | — | 1 | None |

Food Color stain (KOOL-AID) ratings from 1–5
1 = Very heavy stain obtained on control material which was not treated with any of the products.
5 = No red dye stain on nylon.

KOOL-AID (Cherry flavored) contains FDA Red 40 as an artificial color and Citric Acid. When the KOOL-AID powder is dissolved in the prescribed volume of water, the acidity of the soft drink is between pH 2.8–3.0.

The result obtained can be explained as follows:

CENEGEN 7 conveys some food color stain blocking action, but by far not as perfect as INTRATEX N-1. However, CENEGEN 7 does not cause any yellowing during exposure to a Xenon lamp, which represents exposure to sunlight behind glass. The combination of CENEGEN 7 and INTRATEX N-1 illustrates the synergistic stainblocking action. Moreover, the combination of the two products results in less yellowing of the substrate during exposure to Xenon light. This feature represents a superior commercial advantage over individual treatments done with INTRATEX N-1 and similar products.

EXAMPLE 3

Aftertreatment in Exhaust Application

Three 100 gram pieces of carpet nylon 66 Seussen Set were exhaust dyed with acid dyes to a light Grey shade using the following dye combination:

0.025 O.W.F. NYLANTHRENE ORANGE 3G (C.I. Acid Orange 156)

0.018 O.W.F. NYLANTHRENE RED B-2BSA (C.I. Acid Red 266)

0.016 O.W.F. NYLANTHRENE BLUE BAR (C.I. Acid Blue 324)

at a pH of 6.5 and a liquor ratio of 20:1. The temperature of the dyebath was initially 65°–75° F. The carpet was treated for about 10–15 minutes in a manner to promote level dye uptake. The temperature of the bath was then raised to 205°–210° F. at 2° F. per minute and maintained for 30 minutes. Then the temperature was allowed to drop to about 170° F. before the bath was dropped and replaced with clean water in preparation for a rinse and aftertreatment with a food color stain blocking agent. To each of the three baths, 3 grams of the following products (stainblockers) were added and the pH adjusted to 2.5 with Sulfamic Acid. Samples (1), (2), and (3) were treated with:

(1) 3% CENEGEN 7
(2) 3% INTRATEX N-1
(3) 3% of a mix consisting of:
  1.8% INTRATEX N-1
  1.2% CENEGEN 7

The temperature of the three baths was raised to 140° F. and maintained for 30 minutes while the carpet was stirred to promote level uptake of the stain blocking agent. The carpets were removed from the baths and rinsed briefly with clean water. After drying, the carpet was tested with the Food Color stain test (KOOL-AID) and for the tendency to yellow to 40 Xenon standard fading units.

Results:

Partial food color stain blocking was achieved with CENEGEN 7 alone, however this degree is unacceptable commercially. The best blocking was obtained with INTRATEX N-1, accompanied however with unacceptable yellowing. The stain blocking ability of the combination is very close to INTRATEX N-1 alone but with an acceptable degree of yellowing. The major difference in the treatments can be found in the lightfastness of the treated carpet samples. There, the least amount of shade change is observed when CENEGEN 7 is used. The very slight fade occurs in the opposite direction, i.e. a slight yellowish cast present on the fiber after the treatment fades to a pure white. When INTRATEX N-1 is applied to the fiber, a very slight tan coloring is obtained which fades into a bright-yellow when exposed to the Xenon lamp. This results in a commercially unacceptagble fading (2–3) on a rating with the Gray scale*. The much lower fading obtained with the synergistic mix of CENEGEN 7 and INTRATEX N-1 is commercially acceptable and so is the stain blocking effect.

*ISO International standard R105/1

EXAMPLE 4

The stain blocking action can also be achieved during the actual dyeing of the nylon carpet. The same trichromy of orange, red and blue acid dyes of example 3 was used to dye a Tan shade on nylon 66, Seussen-®Heat Set and Superba ®Heat Set. In addition to the dye, 2.5–3.5% O.W.F. of the synergistic mix (CENEGEN 7 and INTRATEX N-1) was added. 2.5% O.W.F. on Seussen Heat Set nylon 66 and 3.5% O.W.F. on Superba Heat Set nylon 66. As a control we dyed the same Tan shade on the two types of heat set carpets in the absence of our mixed products with the pH adjusted to about 6.2 using MSP/DSP (Monosodium phosphate/disodium phosphate). The dyebath temperature was raised to 205°–210° F. and maintained for about 30 minutes. Upon cooling, the carpet was rinsed and dried.

To check the efficiency of the treatment during a dyeing cycle, 2"×2" pieces of carpet were subjected to the KOOL-AID Food Color stain test. Compared to the Control which was stained into a medium dark red, the carpet (Seussen and Superba) teated with the synergistic mix did not stain in the KOOL-AID test.

We claim:

1. A synergistic stain blocking composition for preventing a fiber from being permanently stained comprising an effective amount relative to the fiber treated of: (A) a sulfonated phenol-formaldehyde or naphthol-formaldehyde condensation product and an effective amount of: (B) an anionic surface active agent wherein said condensation product contains at least one sulfone group and between 0.5 to 2 moles of sulfonic groups to 4 moles of phenol or naphthol, the percent ratio of (A):(B) is 60–75:, the condensation product has an average molecular weight of less than 1,000 and the anionic surface active agent has the formula:

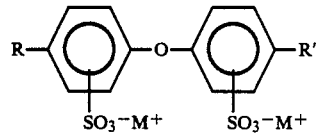

or

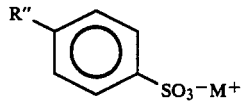

where at least one of the radicals, R, R' and R", is an alkyl chain, branched or ,linear, with 4 to 18 carbons, where one of the radical, R or R' may be H, and where M is a cation selected from the group consisting of H, an alkali metal, $NH_4$ or an amine.

2. A process for preventing a fiber from being permanently stained comprising adding an anionic surface active agent to a sulfonated phenol-formaldehyde or a naphthol-formaldehyde condensate containing a sufficient weight ratio of stain blocking composition to fibers and a sufficient amount of a condensation product to impart stain resistance to a fiber finish and maintaining a suitable pH and temperature to a resulting solution, wherein the condensate contains at least one sulfone group and between 0.5 and 2 moles of sulfonic groups to 4 moles of phenol or naphthol.

3. The composition of claim 1, wherein the sulfonated phenol-formaldehyde or naphthol-formaldehyde condensation product includes sulfonic groups and sulfone groups.

4. The composition of claim, wherein the concentration of the product is 0.15% to 0.6% on weight of fiber and the mole ratio of sulfonic to sulfone groups is 1:4 to 4:1.

5. The composition of claim 1, wherein the concentration of the anionic surface active agent is 0.2%–0.8% on the weight of fiber.

6. A process for preventing a fiber from being permanently stained comprising adding an (A) anionic surface active agent and a (B) sulfonated phenol-formaldehyde or a naphthol-formaldehyde condensate in a sufficient amount to impart stain resistance to a fiber finish, maintaining a pH of 3.5 to 10 and a temperature of about 140°–210° F. (60° C.–99° C.), and treating the fiber wherein the condensate contains at least one sulfone group and between 0.5 and 2 moles of sulfonic groups to 4 moles of phenol or naphthol and said anionic surface active agent has the formula:

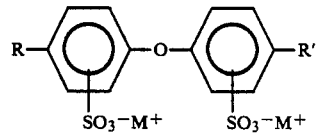

or

-continued

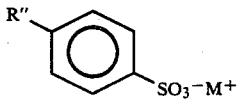

where at least one of the radicals, R, R′ and R″ is an alkyl chain, branched or linear, with 4 to 18 carbons, where one of the radicals, R or R′, may be H, and where M is a cation selected from the group consisting of H, an alkali metal, $NH_4$ or an amine the percent ratio of (A): (B) is 60–75: 40–25 and the condensation product has an average molecular weight of less than 1,000.

7. The process of claim 6, wherein the ratio of the sulfonated phenol-formaldehyde or naphthol formaldehyde condensate to the anionic surface active agents is 4:1 to 0.3:1.

8. The process of claim 6, wherein the pH of the solution is no higher than 6.

9. The process of claim 6, wherein said weight ratio is in the range of 0.5:1 to 50:1.

10. The process of claim 6, wherein the fiber is a polyamide.

11. The process of claim 6, wherein the polyamide fiber is nylon 6 to 66.

12. The process of claim 6, wherein the process is achieved during exhaust dyeing, or as an exhaust aftertreatment following exhaust dyeing, or during both exhaust dyeing and as a exhaust treatment after application, or during continuous dyeing, or as a continuous aftertreatment, or during both exhaust dyeing and as a continuous aftertreatment application.

13. The process of claim 6, wherein the sulfonated phenol-formaldehyde or naphthol-formaldehyde condensation product includes sulfonic groups and sulfone groups.

14. The process of claim 6, wherein the anionic surface active agent is:

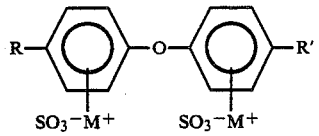

where at least one of the radicals, R and R′, is an alkyl chain, branched or linear, with 4 to 18 carbons, where one of the radicals, R or R′, may be H and where M is H, or a alkali metal or $NH_4$ or a amine.

15. The process of claim 6, wherein the anionic surface active agent is an alkyl-aryl sulfonate of the following formula:

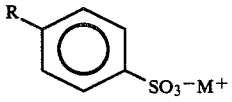

where

R=alkyl chain, branched or linear, with 4 to 18 carbons, preferably 10 to 18 carbons, and M=H, or an alkali metal, or $NH_4$ or an amine.

* * * * *